US007137281B1

(12) United States Patent
McCorvey

(10) Patent No.: US 7,137,281 B1
(45) Date of Patent: Nov. 21, 2006

(54) PROCESS AND APPARATUS FOR FORMING OVERSIZED CIRCULAR PIPE

(76) Inventor: Robert L. McCorvey, 9143 Penn Manor, Houston, TX (US) 77055

( * ) Notice: Subject to any disclaimer, the term of this patent is extended or adjusted under 35 U.S.C. 154(b) by 111 days.

(21) Appl. No.: 10/784,097

(22) Filed: Feb. 23, 2004

(51) Int. Cl.
*B21C 37/12* (2006.01)

(52) U.S. Cl. ..... 72/49; 72/370.23; 72/370.25

(58) Field of Classification Search ..... 72/49, 72/50, 51, 52, 135, 139, 146, 168, 370.23, 72/370.24, 370.25, 110; 29/33 D, 781, 897.2; 140/112
See application file for complete search history.

(56) References Cited

U.S. PATENT DOCUMENTS 2,786,435 A * 3/1957 Ellzey ..... 29/897.2
3,067,707 A * 12/1962 Ellzey ..... 72/50
3,464,253 A * 9/1969 Boyles et al. ..... 72/364
4,232,813 A * 11/1980 Eaton ..... 228/147
4,436,239 A 3/1984 Tsuyama et al.
4,567,742 A 2/1986 Castricum
4,706,481 A * 11/1987 Castricum ..... 72/49
4,711,110 A * 12/1987 Castricum ..... 72/49
4,924,684 A 5/1990 Castricum
4,951,493 A 8/1990 Fragge et al.
5,051,081 A 9/1991 Kammorii
5,105,639 A 4/1992 Castricum
5,478,123 A 12/1995 Kanao
5,609,055 A * 3/1997 Castricum ..... 72/49
5,636,541 A 6/1997 Castricum
5,881,442 A * 3/1999 Hultberg et al. ..... 29/33 D
6,105,227 A 8/2000 Bota
6,110,412 A 8/2000 Anderson
6,622,680 B1 9/2003 Kino et al.
6,655,182 B1 * 12/2003 Mattsson ..... 72/110

* cited by examiner

*Primary Examiner*—Dmitry Suhol
(74) *Attorney, Agent, or Firm*—Egbert Law Offices

(57) ABSTRACT

A process for forming oversized circular pipe has the steps of affixing an elliptically-shaped forming head onto a spiral pipe forming machine, driving a metal strip along the forming head such that the metal strip takes on a shape of the forming head, moving said metal strip out of the forming head into a spiral pattern such that edges of the metal strip engage with each other so as to form an elliptically-shaped spiral pipe, removing the spiral pipe from the forming machine, and forming the elliptically-shaped pipe into a circular shape. The circular pipe has a diameter of greater then forty-eight inches. The forming head has an adjustable diameter.

12 Claims, 4 Drawing Sheets

PROCESS AND APPARATUS FOR FORMING OVERSIZED CIRCULAR PIPE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to methods and apparatus for formation of circular pipe. More particularly, the present invention relates to those apparatus for the forming of circular pipe in which a spiral metal strip has edges joined to itself so as to define the spiral pipe. More particularly, the present invention relates to methods and apparatus for forming spiral circular pipe having oversized diameters.

BACKGROUND OF THE INVENTION

Spiral seamed pipes made from strips of sheet metal are widely used to transport fluids. For example, these pipes are frequently used to transport air in order to ventilate, heat and cool buildings. In this application, as well as others, it desired that the pipe produced is strong, lightweight and inexpensive, and provides minimum resistance to fluid flow. The pipe must be sufficiently strong to maintain rigidity over long expanses and against pressure from external forces. Any aberration in the uniformity of the inner pipe surface, such as bends or dents, increases the resistance to fluid flow through the pipe. It is desirable for the pipe to be lightweight so that less manpower is required to carry and install it.

In the past various U.S. patents have issued for devices relating to the formation of spiral pipe. U.S. Pat. No. 4,567,742, issued on Feb. 4, 1986 to W. P. H. Castricum, describes a ribbed spiral pipe producing machine. This machine includes conventional elements of a frame, a drive roller for feeding the strip through the frame, a flange roller and folding finger for bending the outer edges of the metal strip, a forming head for forming the strip into a pipe so that the outer edges of the strip mate, and a clenching roller and contra roller for compressing the mated edges to produce a spiral seam. This patented device improves on conventional apparatus by providing only two pairs of edge forming roller assemblies that cooperate to bend the left edge of the strip perpendicular to the strip, and the right edge of the strip into an upward facing, V-shaped channel with its outer edge perpendicular with respect to the stip.

U.S. Pat. No. 4,924,684, issued on May 15, 1990 to W. P. H Castricum, describes a apparatus and method for forming and cutting spiral pipe. The pipe forming apparatus includes an enclosed forming head and a mandrel. A continuous strip of metal is driven around the mandrel and inside a lateral bore in the forming head in a helical manner. First and second rollers are mounted in the forming head so as to partially form a spiral lockseam. A third roller is mounted in the upper portion of the forming head so as to close the spiral lockseam. The mandrel is both rotatable and pivotable.

U.S. Pat. No. 5,105,639, issued on Apr. 21, 1992 to W. P. H. Castricum, also discloses an apparatus for forming spiral pipe. In particular, this device is configured for forming spiral pipe having a diameter of approximately one inch or less. A continuous strip of metal is driven around the mandrel and inside a lateral bore in the forming head in a helical manner. First and second rollers mounted in the forming head partially form a spiral lockseam. A third roller mounted in the upper portion of the forming head closes the spiral lockseam. Various knives are employed so as to sever the pipe as it rotates.

U.S. Pat. No. 5,609,055, issued on Mar. 11, 1997 to W. P. H. Castricum, teaches a method and apparatus for cutting and notching a hollow pipe. This apparatus includes a upper knife assembly having a pipe cutting knife and notch cutting knives with cutting edges adjacent a surface of the pipe and a lower knife assembly having a pipe cutting knife and notch cutting knives with cutting edges adjacent an opposite surface of the pipe. The method of this invention includes stopping the axial and rotational movement of the pipe and moving the lower knife assembly into an overlapping relationship with the upper knife assembly. The notch cutting knives are also moved into cutting position and the axial and rotational pipe movement is resumed.

U.S. Pat. No. 5,636,541, issued Jun. 10, 1997 to W. P. H. Castricum, also teaches an apparatus for forming and cutting spiral pipe having a diameter of less than one inch. The device for slitting the spiral pipe into sections includes a first knife that is positioned inside the spiral pipe and a second knife that is positioned outside of the pipe. A support sleeve is also positioned outside of the pipe and is in a fixed radial position with respect to the pipe. The inner and outer knives and the support sleeve move axially with the pipe as the pipe is severed.

The conventional spiral pipe forming machine is manufactured by Spiral-Helix, Inc. of Buffalo Grove, Ill. On this device, a forming head is positioned on the machine so as to extend outwardly of a frame portion. Conventionally, the forming head is of a relatively small diameter so that relatively small diameters of ductwork can be formed through the use of such spiral pipe forming process. This ductwork is often used for the passing of ventilation, air conditioning and heating within a building or a very large vehicle. The forming rollers associated with the forming head are positioned adjacent to an outwardly extending frame portion. As such, the maximum diameter of forming head that can be accommodated in such machines must be less than seventy-eight inches in diameter. If the spiral pipe is of oversized diameter, then other techniques are required for the creation of such large diameter ductwork. Conventionally, when such oversized ductwork is required in a particular project, the oversize ductwork is not formed through the use of the spiral-Helix machine, but rather through complicated seam welding processes. In other words, the large circular portion of the ductwork are formed on a roll forming machine. Each of these circular sections is then joined and welded together in end-to-end relationship. This process of forming such oversized circular pipe is extremely expensive, requires a great deal of manpower, and is relatively inefficient. Unfortunately, none of the existing machines have the capability of creating such large diameter spiral pipe. Inevitably, if a forming head of such diameter were utilized on the Spiral-Helix machine, then the edges of the circular forming head would contact the frame portions of the machine and prevent adaptation and use thereof. As such, a need has developed so as to create a forming head by which such large oversize diameter spiral pipes can be formed by using such Spiral-Helix machines. Additionally, there is a need in the art to provide the ability to create such oversize ductwork through the use of a spiral forming process rather than seam welding and roll forming.

The requirements to manufacture such large oversize diameter ductwork are particularly important in view of the expanding market for such oversize ducts. Larger athletic facilities are being created throughout the world. These athletic facilities often require the transport of air conditioning and heating to the spectators at the stadiums. As a result, there is a need to transport extremely large volumes of air conditioned or heated air from one location to another within the stadiums and athletic facilities. In other circumstances, larger and larger buildings are being built for manufacturing facilities, entertainment facilities and residential facilities. In view of the size of these large buildings, it is desirable to have such oversized ducts for the transport of large volumes of air from one location to another. Still, and in addition, there is a further requirement to have air conditioning and heating facilities at one location while the requirements of use of such air conditioned or heated air are at a remote location. Once again, there is a need for oversized ducts for the transport of such large volumes of air. There is a need at the present for the creation of such large ductwork through the spiral forming processes associated with previously small diameter ducts.

Typically, forming heads used for the creation of such circular pipe are relatively expensive. These forming heads are typically roll formed of steel or aluminum material. The forming heads must be sufficiently strong so as to withstand the forces associated with the formation of the spiral pipe. In certain circumstances, minor adjustments in the diameter of the spiral pipe are necessary after the forming head has been manufactured. If minor adjustments to the diameter of the circular pipe are required, then the previously manufactured forming head must be scrapped and a new forming head created. As such, a need has developed so as to be able to adjust the diameter of the forming head with minimal cost and inconvenience. Additionally, where the forming head is of a relatively large diameter, a need has developed so as to avoid deflections in the large diameter of the forming head.

It is an object of the present invention a method and apparatus for the forming of oversized circular pipe which utilizes spiral forming procedures.

It is another object of the present invention to provide a method and apparatus for the formation of oversized circular pipe which can utilize the Spiral-Helix machines.

It is another object of the present invention to provide a method and apparatus for the formation of spiral pipe which provides the ability to form spiral pipe having a diameters of greater than forty-eight inches without offsetting the forming head.

It is another object of the present invention to provide a method and apparatus for the spiral pipe formation of circular pipe which minimizes the costs and labor required for such sections of circular pipe.

It is still another object of the present invention to provide a method and apparatus for the formation of circular pipe which allows the forming head to be adjusted between diameters without significantly increasing the cost of the forming head.

These and other objects and advantages of the present invention will become apparent from a reading of the attached specification and appended claims.

BRIEF SUMMARY OF THE INVENTION

The present invention is a process for the forming of oversized circular pipe comprising the steps of: (1) affixing an ecliptically-shaped forming head onto a spiral pipe forming machine; (2) driving a metal strip along the elliptically-shaped forming head such that the metal strip takes on a shape of the forming head; (3) moving the metal strip out of the forming head in a spiral matter such that edges of the metal strip engage with each other so as to form an elliptically-shaped spiral pipe; (4) removing the elliptically-shaped spiral pipe from the spiral pipe forming machine; and (5) forming the elliptically-shaped pipe into a circular pipe. The elliptically-shaped forming head has a shape such that the circular pipe has a diameter of greater than forty-eight inches.

The method of the present invention also includes the steps of placing the frame adjacent to the spiral pipe forming machine and positioning rollers on the frame so as to rollably contact the exterior surface of the elliptically-shaped spiral pipe. A cross bar is affixed to cross the elliptically-shaped forming head. A beam is secured in a fixed position relative to the cross bar. The beam is then connected to the cross bar so as to properly support the forming head in a desired vertical orientation. The portion of the forming head having the sharpest curvature is located at the bottom of the forming head. This portion is affixed to the spiral pipe forming machine. A frame portion of the spiral pipe forming machine is spaced away from the portion of the forming head of greatest curvature. In the process of the present invention, a step is required so as to calculate the shape of the forming head such the forming head does not contact and is spaced from this frame portion.

The step of forming the elliptically-shaped spiral pipe into the circular pipe includes joining an end of the elliptically-shaped spiral pipe onto an end of a section of the circular pipe. In the process of the present invention, there is also the step of adjusting a diameter of the elliptically-shaped forming head such that the circular pipe is of a desired diameter. This step of adjusting the diameter comprising the steps of: (1) forming a first break on one side of the elliptically-shaped forming head; and (2) placing a first insert element between edges at the first break; and (4) placing a second insert element between the edges at the second break. Additionally, a second break can be formed on an opposite sides of the elliptically-shaped forming. This allows a second insert element between the edges of the second break. Each of the first and second insert elements has an interior surface flush with an interior surface of the elliptically-shaped forming head at the first and second breaks. Specifically, in this step, a first flange is affixed to one edge of the first break and a second flange is affixed on an opposite side of the first break. The first insert element has a third flange extending outwardly therefrom and a fourth flange extending outwardly therefrom in generally parallel relationship to the third flange. The first insert element is positioned between edges of the elliptically-shaped forming head at the first break such that the third flange is juxtaposed against the first flange and such that the fourth flange is juxtaposed against the second flange. The first flange is bolted to the third flange. The second flange is bolted to the fourth flange.

The present invention is also a forming head apparatus for forming oversize circular pipe. This forming head apparatus includes an elliptically-shaped body having an exterior surface and an interior surface, and a means for securing the elliptically-shaped body to a circular pipe forming machine such that the body has a sharp curvature at a bottom end thereof and at the forming machine. A frame with rollers is provided with the rollers rotatably mounted thereon. These rollers rotatably contact a surface of the circular pipe. The elliptically-shaped body includes a cross bar affixed thereto and extending thereacross. This cross bar is affixed to a beam extending in parallel relationship thereto. The beam is anchored to an exterior surface. The beam is not necessary, but it helps to stabilize the forming process.

In one form of the forming head apparatus of the present invention, there is formed a first break on one side thereof and a second break on an opposite side thereof. A first insert element is removably positioned between the edges of the body at the first break. A second insert element is removably positioned between the edges of the body at the second break. The body has a first flange extending outwardly of the exterior surface adjacent to one of the edges of the first break and a second flange extending outwardly of the exterior surface adjacent another of the edges of the first break. A third flange is affixed to the first insert element at a top thereof. A fourth flange is affixed to the first insert element at a bottom thereof. The third flange is secured to the first flange on the body. The fourth flange is secured to the second flange on the body such that an interior surface of the first insert element is flush with the interior surface of the body. A similar structure is associated with the second break and the second insert element. The first and third flanges have at least one bolt extending therethrough and secured thereto. The second and fourth flanges also have at least one bolt extending therethrough and secured thereto.

In the apparatus of the present invention, a metal strip extends along the interior surface of the forming head and extends outwardly therefrom in the form of an elliptically-shaped spiral pipe. This spiral pipe will have a diameter of greater than forty-eight inches.

DETAILED DESCRIPTION OF THE INVENTION

Figure 1:
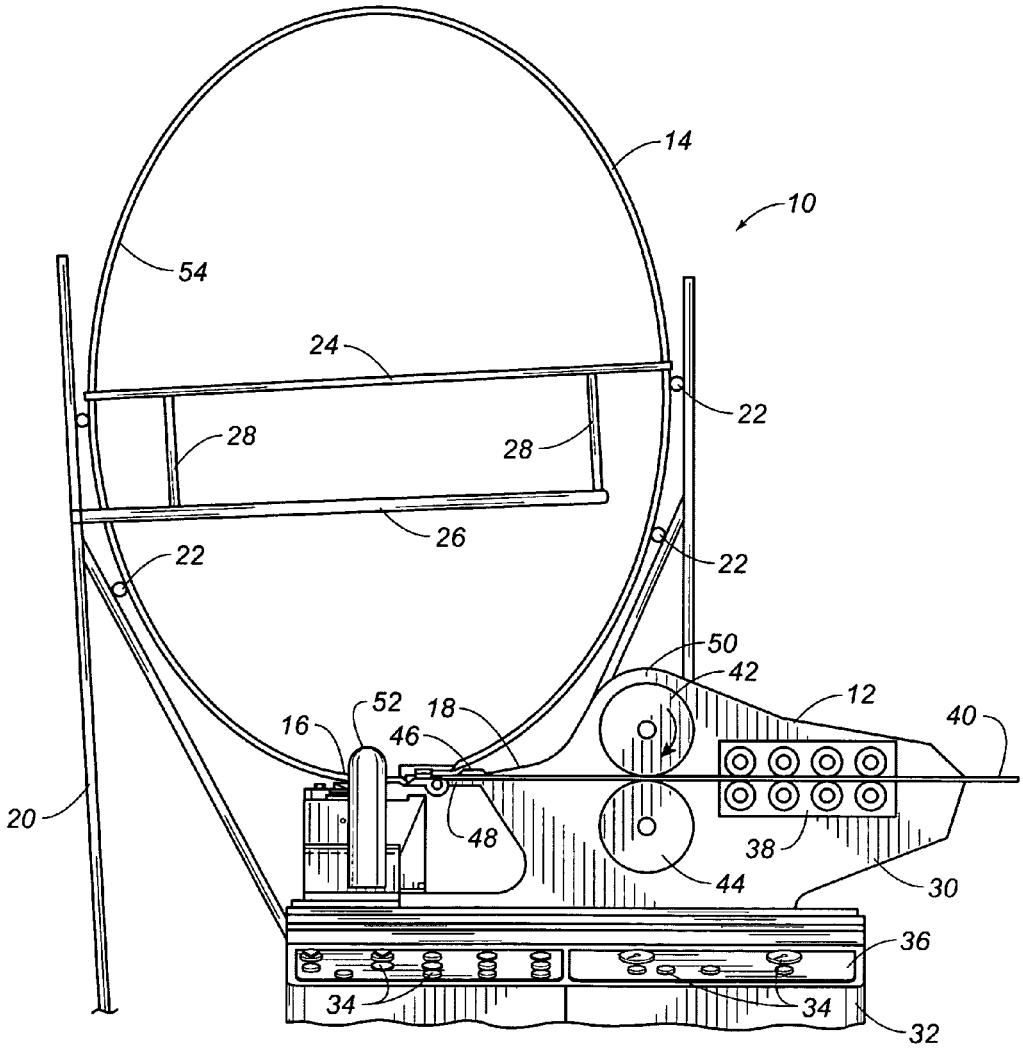
FIG. 1 is a side elevational view showing the method and apparatus for the formation of circular pipe in accordance with the teachings of the present invention.

Referring to FIG. 1, there is shown the apparatus 10 of the present invention for forming an oversize circular pipe. The apparatus includes spiral pipe forming machine 12 along with the elliptically-shaped forming head 14. The elliptically-shaped forming head 14 has a bottom end 16 of sharpest curvature supported on the bed 18 of the forming machine 12. A frame structure 20 extends upwardly from the floor upon which the machine 12 rests. Frame structure 20 includes several rollers 22 that are positioned in various locations so as to ride against the exterior surface of the circular pipe produced by the apparatus 10. A cross bar 24 extends across the narrow diameter portion of the elliptically-shaped forming head 14 so as to maintain the structural integrity of the forming head. A beam 26 is secured to an external structure, or is secured to frame 20, if required. Struts 28 serve to connect the cross bar 24 to the beam 26 and to maintain the structural integrity of the ellipse formed by the elliptically-shaped forming head 14.

The machine 12 is a conventional spiral pipe forming machine such as those manufactured by Spiral-Helix, Inc. of Buffalo Grove, Ill. This spiral pipe forming machine 12 includes a frame 30 and a control cabinet 32. A plurality of control knobs, gauges and dials 34 are located on the control panel 36 for controlling and monitoring the operation of the machine 12.

A roller housing 38 is mounted on the frame 30. The roller housing 38 contains a plurality of rollers which bend the edges of the metal strip 40 in predetermined shapes for forming a lockseam, and which may form corrugation grooves and stiffening ribs in the metal strip 40. An upper drive roller 42 and a lower drive roller 44 are rotatably mounted within the frame 30 adjacent to the roller housing 38. The upper drive roller 42 pulls the continuous metal strip 40 into the frame 30 through the roller housing 38, and over the lower drive roller 44. The drive rollers then cooperate to push the metal strip 15 between the upper guide plate 46 and the lower guide plate 48 into the forming head 14.

The forming head 14 curls the metal strip in a helical manner so that the outer pre-formed edges of the strip 40 are adjacent to each other and mesh therewith. The helically-curled strip thus takes the shape of a spiral cylinder. The adjacent, mated edges of the strip are then compressed between a support roller and a clenching roller so as to form a proper lock seam. The metal strip 40 is continuously pushed by the drive rollers 42 and 44 through the forming head 14, in spiral manner, so that the spiral pipe is continuously produced with a spiral lockseam.

As the spiral pipe is formed, it will move out of the forming head 14 in a spiral manner. That is, the pipe and its leading edge will simultaneously rotate and move forward in the axial direction of the pipe. The pipe will be continuously produced until its reaches its desired length. At that point, a pipe cutting and notching apparatus will notch and sever the pipe into a section.

Importantly, in FIG. 1, it can be seen that the frame 30 includes a frame portion 50 that is positioned adjacent to the periphery of the forming head 14. This frame portion 50 is essential for the proper positioning of the drive rollers 42 and 44. The drive rollers 42 and 44 push the metal strip 40 between the upper guide plate 46 and the lower guide plate 48 and into the support arm 52. Support arm 52 pushes down on the support roller and holds it in place. As such, the metal strip 40 will start to follow a path along the interior surface 54 of the elliptically-shaped forming head 14. As a result, the elliptically-shaped forming head 14 will create an elliptically-shaped spiral pipe, rather than the circular-shaped pipe of the prior art.

As can be seen, the location of the frame portion 50 would create a obstruction relative to the support arm 52 and the location of the elliptically-shaped forming head 14 if the elliptically-shaped forming head 14 were of a circular configuration. The frame 50 creates an inherent barrier to the expansion of duct diameters beyond forty-eight inches in diameter. If the forming head 14 were circular, then extensions would have to be formed outwardly of the machine 12 in an inconvenient and unreliable manner. So as to accommodate the location of the frame 50, the elliptically-shaped forming head 14 is positioned so that the sharp curvature of the forming head 14 is located at the support arm 52 and on the bed of the machine 12. As a result, the sides adjacent to the frame portion 50 can extend upwardly therefrom in generally spaced relationship and non-interfering relationship with frame portion 50. The support frame 20 will maintain the elliptically-shaped forming head 14 in its desired orientation above the machine 12. As a result of the structure of the present invention, it is now possible to form circular pipe having diameters of greater than forty-eight inches. In order to determine the proper ellipse for the elliptically-shaped forming head 14, it is first necessary to understand the desired diameter of the ultimate circular pipe. Once the desired diameter is determined, then it is necessary to know the spacing between the support arm 20 and the frame portion 50. As a result, a properly shaped ellipse of the elliptically-shaped forming head 14 can be calculated. As an example, if the ultimate diameter of the circular pipe is 100 inches then the elliptically-shaped forming head 14 will have a narrow diameter of 85 inches and a wide diameter of 114 inches.

Figure 2:
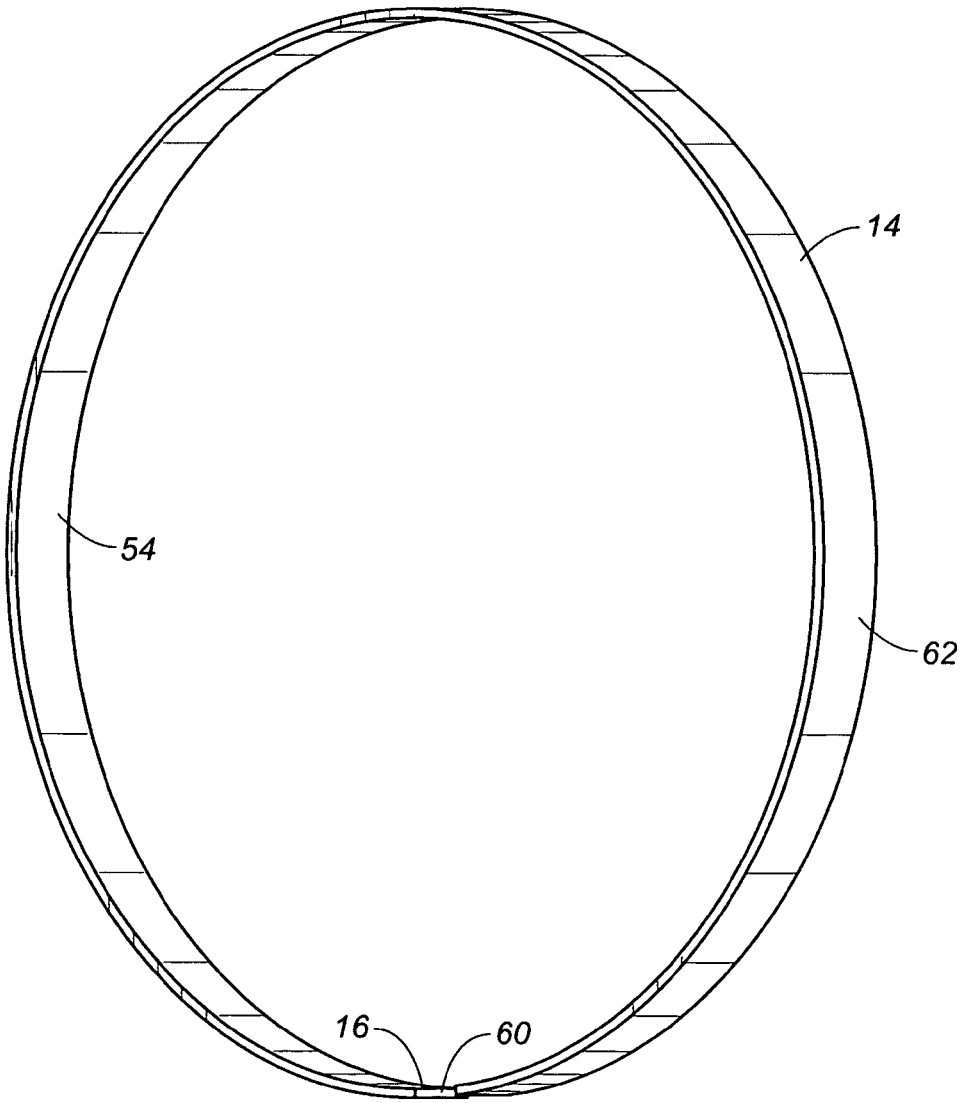
FIG. 2 is a perspective view showing the elliptically-shaped forming head in accordance with the teachings of the present invention.

FIG. 2 is an isolated view showing the elliptically-shaped forming head 14 of the present invention. The forming head 14 is formed of a steel material having a proper ellipse for the purposes of installation on the machine 12. The bottom end 16 of the elliptically-shaped forming head 14 should be positioned under the support arm 52. As a result, a suitable slotted area 60 should be formed at the bottom 16 so as to allow the metal strip 40 to be introduced thereinto. The metal strip 40 is free to be driven along the interior surface 54 in a continuous and spiral manner. The exterior surface 62 can be supported by the frame structures described hereinbefore.

Figure 3:
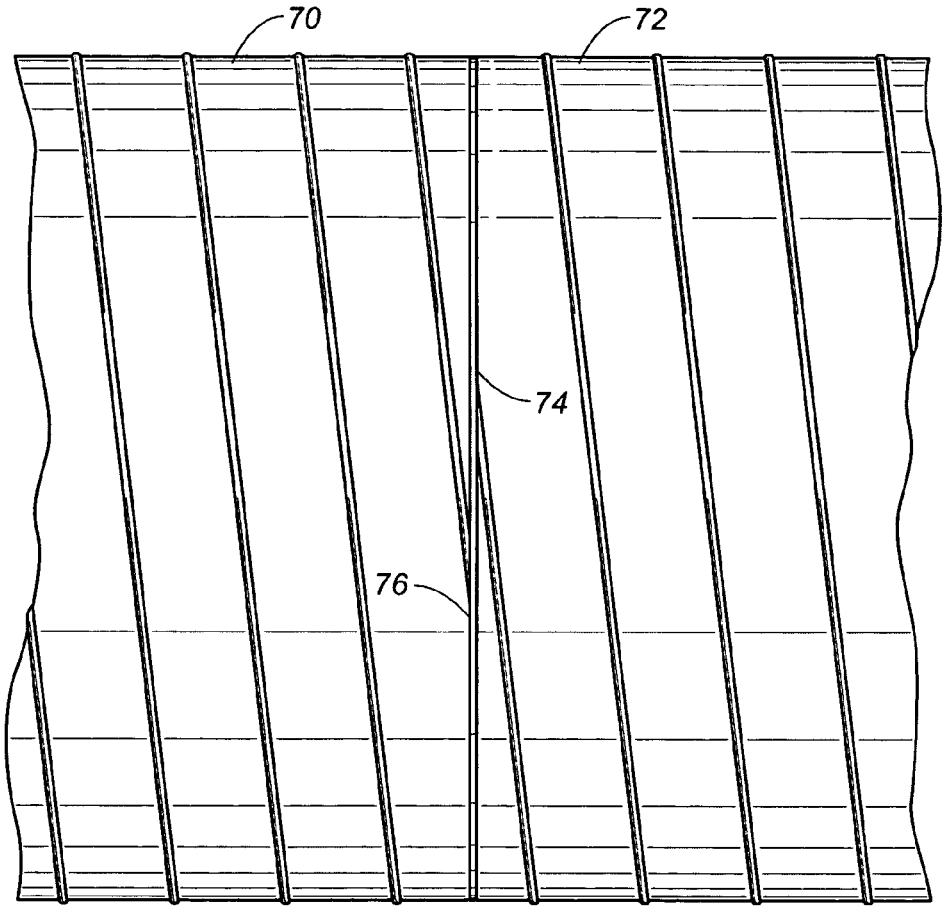
FIG. 3 is a side elevational view showing how an elliptically-shaped spiral pipe can be joined to another pipe section so as to form a circular pipe.

After the machine 12 has driven the metal strip 40 through the interior of the elliptically-shaped forming head, a length of elliptically-shaped spiral pipe will be formed. However, it is important consideration of the present invention that the ultimate goal is to produce a section of circular pipe of constant diameter. As such, the elliptically-shaped spiral pipe will need to be converted into circular pipe. FIG. 3 shows the manner in which this conversion can occur. As can be seen in FIG. 3, a first section 70 of spiral pipe has been positioned in a desired location. This first section 70 is of a circular configuration. The second section 72 illustrates the spiral pipe as formed by the process 10 of the present invention. Spiral pipe 72 will initially be of elliptical form. However, within the concept of the present invention, it is easy to form the elliptically-shaped spiral pipe section 72 into a circular pipe section by simply securing the end 74 of section 72 to the end 76 of section 70. Since the pipe section 72 is elliptically shaped, it can be easily manipulated, maneuvered and adjusted so as to conform with the edge of the circular spiral pipe 70. After connecting the end 74 to the end 76 by various means, such as welding, tapping, adhesive, sealants, or other means, the second pipe section 72 will have its desired circular configuration. Within the concept of the present invention, although the ultimate result of the use of the elliptically-shaped forming head 14 is the creation of elliptically-shaped spiral pipe, the spiral pipe is of a configuration that can be easily manipulated for movement and configuration into a circular design of constant diameter. Fixtures and other supports can be employed so as to maintain the circular orientation of the elliptically-shaped section 72 during its installation onto the circular section 70.

Figure 4:
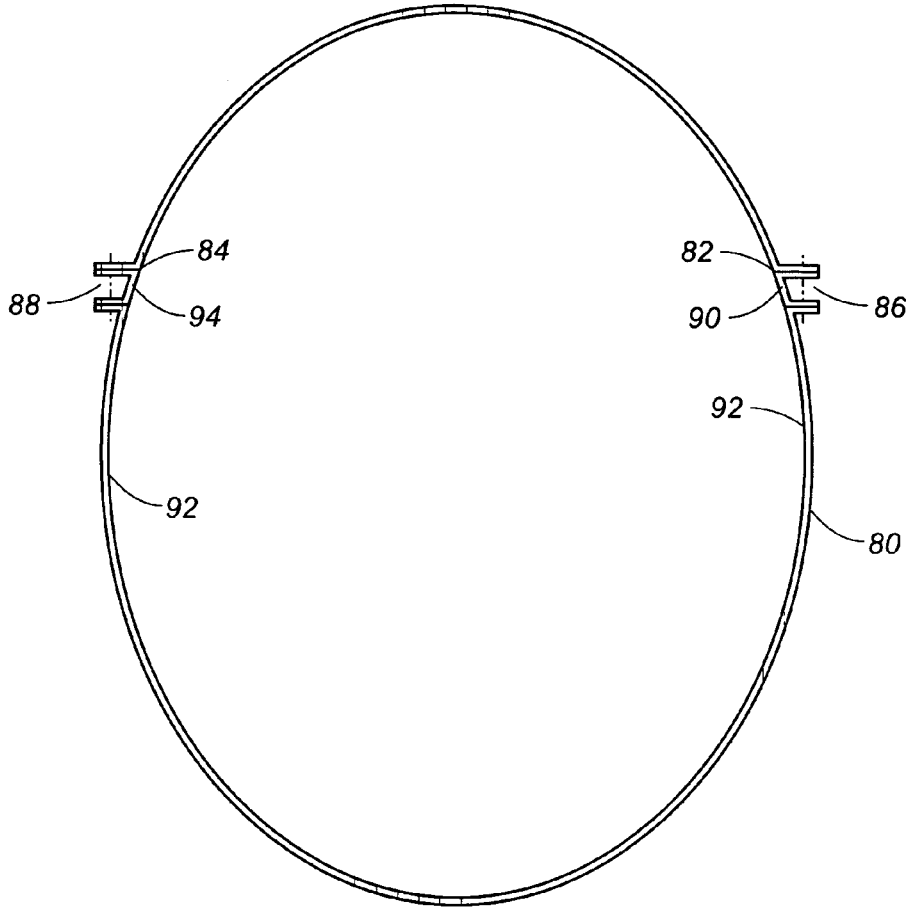
FIG. 4 is a end view showing an alternative embodiment of the circular pipe forming head of the present invention

FIG. 4 shows an alternative embodiment of the elliptically-shaped forming head 80 of the present invention. Forming head 80 has an elliptically-shaped configuration as in the previous embodiment of the forming head 14. However, a first break 82 is formed on one side of the forming head 80 and a second break 84 is formed on an opposite side of the forming head 80. These breaks 84 and 82 are cuts through the wall thickness of the forming head 80. The breaks 82 and 84 are particularly configured so that the forming head 80 can be manipulated for size adjustments and for producing spiral pipe of different diameters. In FIG. 4, it can be seen that an insert element 86 has been positioned between the edges of the break 82. Similarly, another insert element 88 has been positioned between the edges 84. As a result, the wide diameter of the elliptically-shaped forming head 80 is greater by a function of the length of the insert elements 86 and 88. Generally, each of the insert elements 86 and 88 has a U-shaped configuration in which the inner surface 90 of the insert element 86 is flush with the interior surface 92 of the forming head 80. Similarly, the inner surface 94 of the insert 88 is flush with the interior surface 92 of the forming head 80. As a result, there will be no interruption or obstruction of the travel of the metal strip during the formation of the elliptically-shaped spiral pipe. As will be described hereinafter, when the insert elements 86 and 88 are removed, the breaks 82 and 84 will be closed such that the interior surface 92 of forming head 80 is contiguous and flush with itself.

Figure 5:
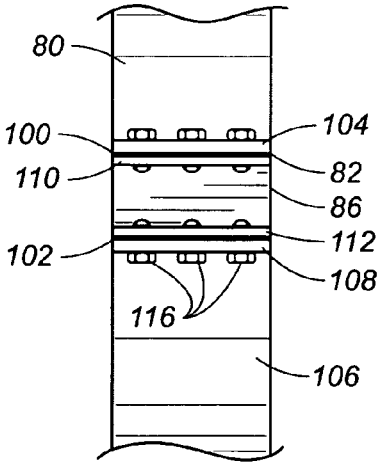
FIG. 5 is a partial side elevational view of the insert structure associated with the alternative embodiment of FIG. 4.
Figure 6:
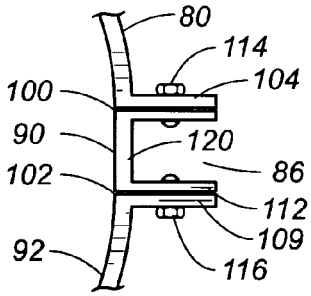
FIG. 6 is a detailed isolated end view showing the insert structure associated with the alternative embodiment of FIG. 4.

FIG. 6 illustrates the configuration of the insert element 86 as positioned on the forming head 80. The insert element 86 is positioned in the area of the break 82. As can be seen in FIG. 5, break 82 will have a first edge 100 and a second edge 102. A first flange 104 extends outwardly of the exterior surface 106 of the forming head 80 at break 100. A second flange 108 extends outwardly of the exterior surface 106 of the forming head 80 at break 102. Importantly, the first insert element 86 includes a third flange 110 positioned in juxtaposition against an interior surface of the first flange 104. The insert element 86 also includes a fourth flange 112 which is positioned in juxtaposition against an inside surface of the second flange 108. Bolts 114 serve to secure the first flange 104 to the second flange 110. Similarly, bolts 116 are used to secure the second flange 108 to the fourth flange 112. As a result, the insert element 86 will fill in the space between the edges 100 and 102 of break 82. A similar structure, such as that shown in FIG. 5, is employed in association with the second break 84 and the second insert element 88 on the other side of the forming head 80.

In FIG. 6, it can be seen how the first insert element 86 is positioned between the first flange 104 and the second flange 108. Insert element 86 has a surface 120 positioned between the edge 100 and the edge 102 of break 82. The inner surface 90 will be flush with the inner surface 92 of the forming head 80. The insert element 86 also shows the third flange 110 and the fourth flange 112. The bolts 114 join the first flange 104 to the third flange 110 in surface-to-surface relationship. Similarly, bolts 116 join the second flange 108 to the fourth flange 112 in surface-to-surface relationship. Suitable bolt holes are formed through each of the flanges 104, 108, 110 and 112 so that proper alignment of the surfaces 90 and 92 can be achieved.

Figure 7:
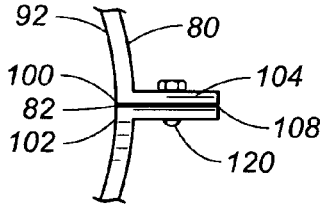
FIG. 7 is an isolated view showing the elliptically-shaped forming head of FIG. 4 without the insert element secured thereto.

In FIG. 7, it can be seen how the insert element 86 has been removed. As a result, the break 82 is closed so that the edges 100 and 102 are in juxtaposition. The inside surface 92 of the forming head 80 will be continuous and flush. The first flange 104 is joined the second flange 108 through the use of bolts 122. Removal of the insert element 86 will cause the maximum diameter of the elliptically-shaped forming head 80 to be reduced in size. If it is necessary to make minor adjustments in the diameter in the forming head 80, then the insert elements 86 and 88 can be suitably employed. As a result, the present invention eliminates the need for constantly scrapping, reforming or otherwise taking other expensive measures for the remedying of diameter discrepancies in the elliptically-shaped spiral pipe.

The foregoing disclosure and description of the invention is illustrative and explanatory thereof. Various changes in the details of the illustrated construction or in the steps of the describesd method can be made within the scope of the appended claims without departing from the true spirit of the invention. The present invention should only be limited by the following claims and their legal equivalents.

I claim:

1. A process for forming oversized circular pipe comprising:

affixing an elliptically-shaped forming head onto a spiral pipe forming machine;

driving a metal strip along said elliptically-shaped forming head such that said metal strip takes on a shape of said elliptically-shaped forming head;

moving said metal strip out of said elliptically-shaped forming head into a spiral pattern such that edges of said metal strip engage with each other so as to form an elliptically-shaped spiral pipe;

removing said elliptically-shaped spiral pipe from said spiral pipe forming machine; and forming said elliptically-shaped pipe into a circular pipe.

2. The process of claim 1, said elliptically-shaped forming head having a shape that said circular pipe has a diameter of greater than forty-eight inches.

3. The process of claim 1, further comprising:

placing a frame adjacent to said spiral pipe forming machine; and positioning rollers on said frame so as to rollably contact an exterior surface of said elliptically-shaped spiral pipe.

4. The process of claim 1, said step of affixing comprising:

affixing a cross bar across said elliptically-shaped forming head;

securing a beam in a fixed position relative to said cross bar; and connecting said beam to said cross bar.

5. The process of claim 1, said step of affixing comprising:

positioning a portion of said elliptically-shaped forming head of sharpest curvature at a bottom of said elliptically-shaped forming head; and affixing said portion to said spiral pipe forming machine.

6. The process of claim 5, said spiral pipe forming machine having a frame portion spaced from said portion of said sharpest curvature, the process further comprising:

calculating a shape of said elliptically-shaped forming head such that said forming head does not contact and is spaced from said frame portion.

7. The process of claim 1, said step of forming said elliptically-shaped spiral pipe into a circular pipe comprising:

joining an end of said elliptically-shaped spiral pipe onto an end of a section of circular pipe.

8. The process of claim 1, further comprising the step of:

adjusting a diameter of said elliptically-shaped forming head such that said circular pipe is of a desired diameter.

9. The process of claim 8, said step of adjusting the diameter comprising:

forming a first break on one side of said elliptically-shaped forming head;

forming a second break on an opposite side of said elliptically-shaped forming head;

placing a first insert element between edges of said elliptically-shaped forming head at said first break; and placing a second insert between edges of said elliptically-shaped forming head at said second break, each of said first and second inserts having an interior surface flush with an interior surface of said elliptically-shaped forming head at said first and second breaks, respectively.

10. The process of claim 9, further comprising:

affixing a first flange at one edge of said first break;

affixing a second flange at another edge of said first break;

forming said first insert element so as to have a third flange extending outwardly therefrom and a second flange extending outwardly therefrom in parallel relationship to said third flange; and positioning said first insert element between edges of said elliptically-shaped forming head at said first break such that said third flange is juxtaposed against said first flange and such that said fourth flange is juxtaposed against said second flange.

11. The process of claim 10, further comprising:

bolting said first flange to said third flange; and bolting said second flange to said fourth flange.

12. The process of claim 1, said circular pipe having a diameter of 100 inches, said elliptically-shaped forming head having a narrow diameter of 85 inches and a wide diameter of 114 inches.

* * * * *